US006518707B2

(12) United States Patent
Gershen et al.

(10) Patent No.: US 6,518,707 B2
(45) Date of Patent: Feb. 11, 2003

(54) VOLTAGE DETECTOR FOR SERIES LIGHT CIRCUIT

(75) Inventors: Bernard J. Gershen, Centerpoint, NY (US); John DeCosmo, Glenview, IL (US)

(73) Assignee: DG Partnership An Illinois General Partnership, Glenview, IL (US)

( * ) Notice: Subject to any disclaimer, the term of this patent is extended or adjusted under 35 U.S.C. 154(b) by 0 days.

(21) Appl. No.: 09/893,020

(22) Filed: Jun. 22, 2001

(65) Prior Publication Data

US 2002/0195945 A1 Dec. 26, 2002

(51) Int. Cl.[7] ..... H01J 1/60

(52) U.S. Cl. ..... 315/129; 315/185 R; 315/185 S; 315/312; 315/324

(58) Field of Search ..... 315/129, 130, 315/132, 133, 185 R, 192, 185 S, 312, 324; 362/800, 806, 812

(56) References Cited

U.S. PATENT DOCUMENTS 3,573,775 A * 4/1971 Zane ..... 340/228
5,886,423 A * 3/1999 Gershen et al. ..... 301/36
5,942,857 A * 8/1999 Hsu ..... 315/185 S
6,323,597 B1 * 11/2001 Janning ..... 315/185 S

* cited by examiner

*Primary Examiner*—Don Wong
*Assistant Examiner*—Tuyet T. Vo

(57) ABSTRACT

A string of miniature holiday lamps connected in a series circuit with each lamp having an indicating device connected in parallel to its respective lamp. The indicating device is operated in response to the non functioning of the lamp with which it is connected in parallel. When the lamp fails, the full line voltage of the series circuit passes through the indicating device causing it to activate, signaling the non functioning lamp. The signaling device can be a resistor associated with a thermochromic paint that changes color when activated by the heat from the resistor, a sound alarm, an odor activated device or an electroluminescent light. In another embodiment the signaling device can be used to indicate a circuit having a resistive load is energized.

19 Claims, 2 Drawing Sheets

VOLTAGE DETECTOR FOR SERIES LIGHT CIRCUIT

BACKGROUND OF INVENTION

This invention relates to a device for detecting either a burned out lamp or malfunctioning lamp in a string of lights that are connected in series. It is particularly useful in detecting a burned out lamp or defective socket in a string of miniature low voltage holiday lights. It also relates to device that can function as a voltage detector for various applications. Throughout this document, the term non functioning lamp shall be deemed to mean that the lamp is not illuminated due to any of a number of reasons including but not limited to a defective or burned out lamp, or due to a defective socket or failure of the socket to make electrical contact with the lamp.

There are various types of miniature light strings or light sets. Examples of miniature lights and displays can be found in U.S. Pat. No. 5,453,664 to Harris, U.S. Pat. No. 5,624,181 to Miller et al. and U.S. Pat. No. 5,860,731 to Martinez. These strings of lights are often used during holiday times for decorative Christmas tree light strings. Other uses include framing a window with a series of miniature lights or wrapping a string of miniature holiday lights around a wreath that is in turn hung on a wall. The miniature light sets include a plurality of light sockets disposed along and electrically connected to an electrical wire or conductor. A miniature lamp is mounted in each socket. All of the lamps are connected in a series circuit.

In standard household applications, the voltage available is 120 volts A.C. For an extended length of lights, such as used on Christmas trees or other extended length applications, the miniature lamps are generally 2.4 volt incandescent lamps. So that the lamps will operate in this environment, a standard string of miniature lights has fifty lamps that are connected in series. Thus there is approximately a 2.4 volt drop across each lamp.

In another example there are one hundred lamps in a standard string. In this case the lamps are 1.2 volt incandescent lamps with approximately a 1.2 volt drop across each lamp.

The main problem with the string of holiday lights is detecting a burned out lamp in a series circuit. The problem is especially acute in the case of fifty or one hundred lamps connected in series where, if one lamp fails, or merely is removed or not making electrical contact with its socket, the entire string of lights go out unless there is a shunt integral with each lamp, to maintain the other lamps lit. The shunt keeps current running through the socket in the event that the lamp bums out. When this occurs, the voltage distributed among the remaining lamps is increased thus reducing the life of the remaining lamps in the string.

A problem that has not been solved by past devices is identifying a particular lamp that is burned out or not making electrical contact with its socket. If all of the lamps in a string are off, the user can't readily identify which lamp is the non-functioning lamp. If the lamps have been carefully placed so as to make the effect look natural, it is even more difficult to find the non-functioning lamp. This is especially true for artificial factory wired Christmas trees. In the past the user had to check each lamp individually until the burned out lamp or lamp not properly making contact is found. Obviously, this is time consuming and frustrating for the user. In some instances, the user may become so frustrated that an entire string of lights may be discarded merely because the user couldn't find the bad lamp or the user didn't want to spend the time looking for it.

In another application, a light emitting diode ("LED") is commonly used to indicate when a circuit is energized. For example many household appliances use LED's to indicate that a feature is "on". LED's are relatively expensive compared to small resistors. Thus if a resistor can replace the LED, a cost savings results. Still another application allows a voltage detection device, which may be a resistor, in place of the LED's, neon lamps, or small incandescent lamps. Throughout this application, the term "LED's" shall include light emitting diodes, neon lamps or small incandescent lamps.

OBJECTS AND ADVANTAGES

Thus it is an object of the invention to provide a visual indication to alert the user of a string of holiday lights as to which lamp is either burned out or non-functioning.

It is a related object to provide an electroluminescent indicator that is connected in parallel with each of the holiday lights in a string and illuminates when the lamp with which it is connected in parallel bums out or malfunctions. It is another object to provide a resistor in parallel with each of the holiday lights that heats up above a predetermined level when the lamp with which it is in parallel bums out or malfunctions. A related object is to paint the resistor with thermochromic paint or temperature sensitive liquid crystal paint so that as it heats up it gives a visual indication when the lamp with which it is connected in parallel bums out or malfunctions.

Yet another object is to provide a material that is impregnated with a scent that is released when heated above a predetermined temperature, which occurs when the lamp bums out or malfunctions. Still another object is to provide an audible alarm when a lamp burns out or malfunctions.

An advantage of giving the user an indication of the lamp that has burned out or malfunctioned is that it enables the user to quickly locate and replace the defective lamp or socket.

Another object is to use a voltage detection device in place of other detection means such as light emitting diodes, neon lamps, or small incandescent lamps, to indicate the status of components in an electrical circuit.

SUMMARY OF THE INVENTION

Applicant's invention is a device that solves the problem of locating defective lamps or sockets by alerting the user which lamp is not functioning. Applicant's device connects a signal indicating means in parallel with each lamp. When the lamp is not functioning, the rest of the lamps in the series circuit go off. The full line voltage then appears across the signal indicating means causing a visual signal, alarm sound or odor to be emitted directing the user to the non functioning lamp. Examples of signal indicating means are an electroluminescent indicator, a resistor coated with thermochromic paint or temperature sensitive liquid crystal paint, impregnating the socket with a material that emits an odor when heated, and an alarm sounding device that activates when the voltage increases to a predetermined level. If more than one lamp is not functioning, the signal indicating means can still operate as long as the voltage is sufficient to trigger the signal indicating means.

Applicant's device can further be adapted as a voltage detector to indicate when a circuit is energized. For example, in an appliance heater circuit, the voltage passing through a resistor in parallel with the heating circuit can indicate the status of the circuit without the need to use LED's.

DETAILED DESCRIPTION OF THE PREFERRED EMBODIMENT

Figure 1:
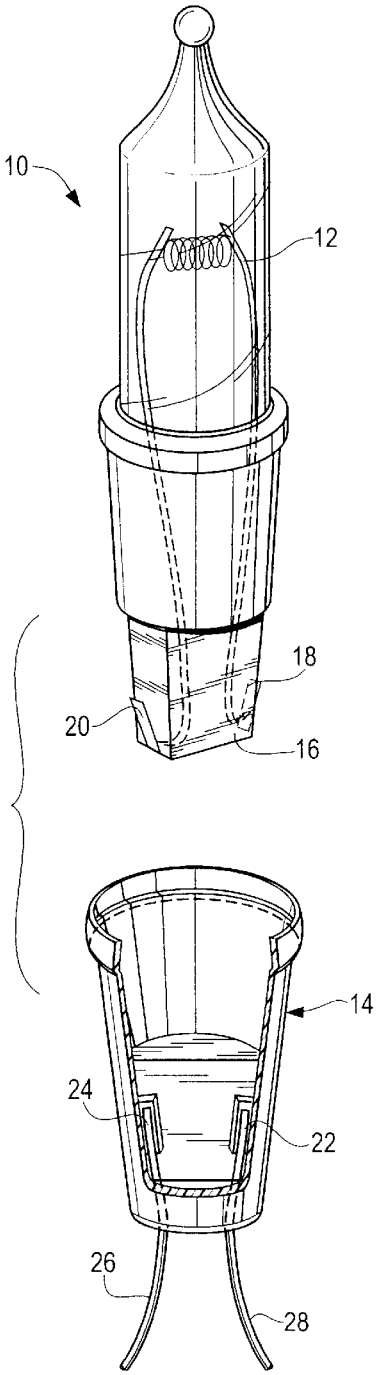
FIG. 1 PRIOR ART
FIG. 1 is an exploded view showing a conventional miniature lamp and socket assembly.

Turning first to FIG. 1 there is illustrated a conventional miniature light 10. The light 10 has a miniature lamp 12 that is received in a socket 14. There is a base 16 at the bottom of the lamp 12. Extending from opposite sides of the base 16 are a pair of lamp wires 18, 20. These are connected to a filament in the lamp 12. The socket 14 has a pair of terminals 22, 24 that make electrical contact with the lamp wires 18, 20 when the lamp is inserted into the socket 14. The terminals are electrically connected to a pair of terminal wires 26, 28 that are connected to a power source.

Figure 2:
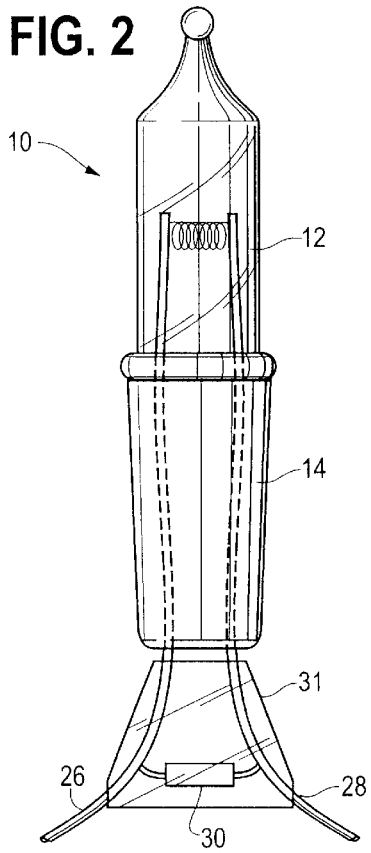
FIG. 2 is a side elevation view of a miniature lamp and socket with a resistor indicator electrically connected in parallel with the lamp.

FIG. 2 is a view of the lamp 10 with a resistor 30 connected in parallel with the lamp 12. The resistor can be located anywhere on or adjacent to the lamp 10. It must only be connected in parallel with the lamp 12. One method is to connect one end of the resistor to the terminal wire 26 and an opposite end of the resistor to the wire 28 as shown in FIG. 2. The resistor 30 and a portion of the wires 26 and 28 can be encased inside of a clear plastic housing 31 to protect the resistor 30 and to provide structural support for the resistor 30 and the wires 26 and 28.

Figure 3:
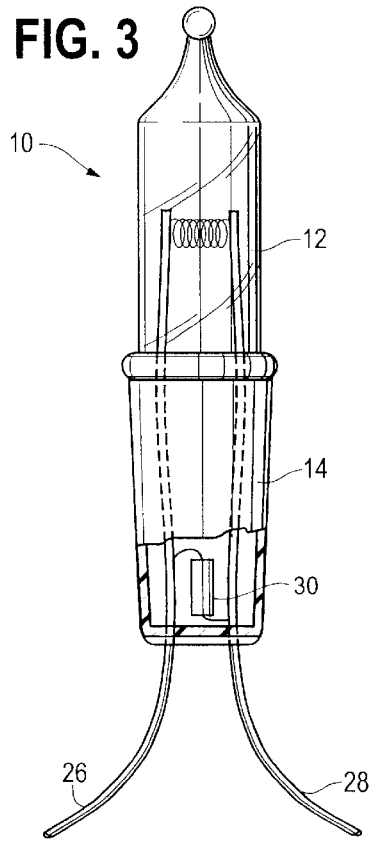
FIG. 3 is a side elevation view of an alternative embodiment of a miniature lamp and socket with a resistor indicator mounted on the socket and electrically connected in parallel with the lamp.

FIG. 3 is an alternative embodiment of a lamp 10 in which the resistor 30 is mounted in an opening in the socket 14. The resistor is electrically connected in parallel with the lamp 12. The resistor can be covered with a clear plastic cover or a thermochromic painted plastic cover as will be described later. The resistor can also be integrally formed into the socket 14 or mounted in a clear housing in the socket. The exact location is not critical, only that it be connected in parallel with the lamp for which it is an indicator. Alternatively, the resistor can be formed internally within the lamp 12 yet still wired in parallel with the lamp filament. This enables the resistor to be mounted into the string of lights at the same time the lamps are installed into their respective sockets. This minimizes one of the manufacturing steps by having the resistor integrally formed with the lamp. However, its operation is identical to a resistor mounted in parallel outside of the lamp.

Figure 4:
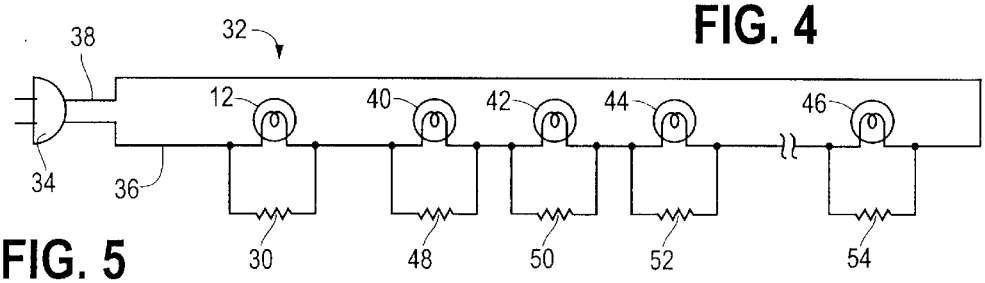
FIG. 4 is an electrical schematic diagram of a string of miniature lights connected in series with a resistor connected in parallel with each light.

FIG. 4 is a schematic diagram of a string of miniature holiday lights 32. There is an electrical plug 34 that is designed to be plugged into a standard wall outlet. Normally the household voltage supplied in the United States is 120 volts a.c. Two conductor wires 36 and 38 exit the wall plug 34. The conductor wire 36 has a plurality of miniature lights or lamps 12, 40, 42, 44, 46 connected in series along the conductor wire. There are generally fifty miniature lamps each rated 2.4 volts and 0.2 amperes connected along the wire 36. The resistance of each lamp is 12 ohms. This results in a drop of approximately 2.4 volts across each lamp. The light string can use other lamps with different voltages and differing numbers of lamps, but the concept of connecting the lamps in series remains the same. In this configuration, when any one lamp burns out, doesn't make contact with its socket, or if the socket is defective, all of the lamps connected in series along the wire 36 go out.

Each of the lights or lamps 12, 40, 42, 44, and 46 has connected a resistor connected in parallel with a lamp. This is shown as resistors 30, 48, 50, 52 and 54 respectively. The method of electrically and physically connecting the resistors is described above. Each resistor is rated 56,000 ohms and ¼ watt in the above-described circuit and can be a tubular carbon film resistor.

The resistors are first painted with the color the user wants to indicate a burned out or malfunctioning lamp condition. Then the resistors are painted or coated with a thermochromic paint. These thermochromic paints are generally available in the industry. This thermochromic paint has the property that above a threshold temperature, it changes from black opaque to translucent or clear. When it is translucent or clear, the color that the resistor was painted shows through the thermochromic layer. It is also possible to mix the paint with the desired color pigments with the thermochromic paint so that it is not necessary to first paint the resistor, thus eliminating one step.

In the normal condition, with all of the lamps "on", the power that each lamp dissipates is 0.48 watts. This is calculated as P=VA, which is 2.4 volts times 0.2 amperes. In order to dissipate ¼ watt in the resistor with 120 volts applied, its resistance equals voltage squared divided by power (which is ¼ watt). Solving the equation, the resistance is calculated as 57,600 ohms, or the nearest standard resistor value is 56,000 ohms. One can see that with each 56,000 ohm resistor in parallel with a lamp of 12 ohms resistance, the resistor will draw a negligible amount of current. The power dissipated per resistor when the lamps are all "on" is about 0.1 milliwatts. This amount of power is not enough to heat the resistor to any perceptible temperature. It will not heat the resistor above the threshold temperature where the thermochromic paint changes to its clear condition. The resistor selected will not exceed its maximum design temperature when ¼ watt is dissipated.

When a lamp burns out, or if a socket is defective causing the lamp to be "off", the voltage across the resistor connected in parallel with the burned out lamp increases to almost the full line voltage. For example, in FIG. 4, if lamp 12 burns out or disconnects from its socket, there is an open circuit causing all of the lamps to go off. Resistor 30 is subjected to substantially the entire line voltage, i.e. 120 volts. The power dissipated by the resistor is 2,500 times greater at 120 volts as compared to 2.4 volts. The resistor heats up to about 158 degrees F. The thermochromic paint changes state at about 100 degrees F. It takes the dye in the thermochromic paint about five seconds to change its state when the 120 volts is applied. In the alternate embodiment shown in FIG. 3, the plastic cover over the resistor may be coated with the thermochromic paint, which changes state upon reaching its threshold temperature. This exposes the painted resistor or the color embedded within the thermochromic paint. This type of indicator is especially well suited in well lit areas as the detector does not supply light to be seen but is visible because of its change in color with respect to its surroundings.

If two lamps, 12 and 40, both burn out or disconnect from their socket at the same time, the voltage will be divided between their respective resistors, 30 and 48. Thus each resistor will be subjected to 60 volts. This is still sufficient to heat the resistors 30, 48 to cause them to change their state.

There is another method of detecting the defective lamp rather than the thermochromic paint. If standard non coated resistors are used, the user can merely feel the resistors for the one that is hotter than the others. As long as the resistors don't become too hot to the touch, or present an electrical hazard, this method will work.

Another method of detection is to coat the resistors with a scented material that emits an odor when the resistor is heated above a threshold temperature. The operation would be similar to the above described thermochromic paint scenario, except instead of thermochromic paint, a scented thermally activated material would be applied to the resistors.

Figure 9:
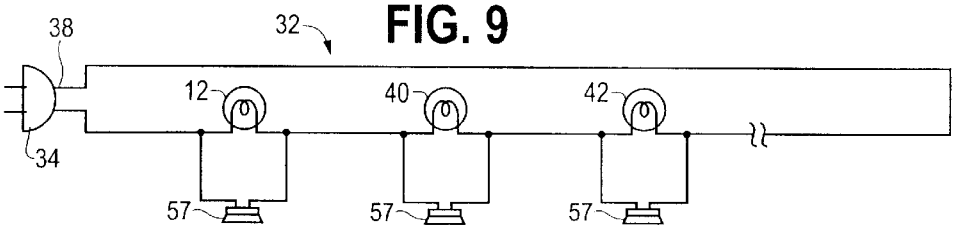
FIG. 9 is an electrical schematic diagram of a string of miniature lights connected in series with an audible alarm connected in parallel with each light.

Still another method of detection is to replace the resistors with an audible alarm mechanism 57 (FIG. 9). During normal operation, the voltage supplied to the alarm 57 is insufficient to trigger its operation. When the lamp bums out or disconnects from its socket, the voltage increases substantially as set forth above. The increased in voltage exceeds the threshold voltage to operate the alarm mechanism 57. The alarm signals that there is a burned out or malfunctioning lamp and the user is directed to the audible sound of the alarm that was triggered.

Figure 5:
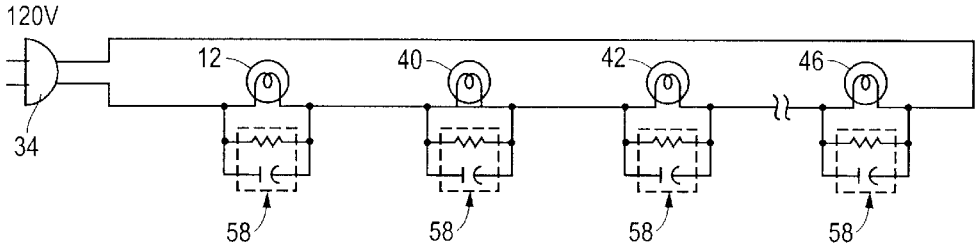
FIG. 5 is an electrical schematic diagram of a string of miniature lights connected in series with an electroluminescent indicator connected in parallel with each light.
Figure 7:
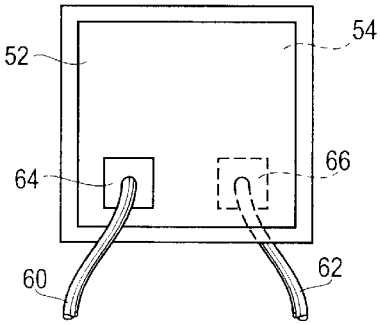
FIG. 7 is a side elevation view of an alternate embodiment of connecting to an electroluminescent lamp.

A different concept is to use an electroluminescent lamp referred to herein as an "EL" illustrated in FIGS. 5 and 7. An EL 58 consists of a special type of phosphor, which is coated on one side with a transparent conductive material 52, and on another side 54 with a non-transparent conductive material. The phosphor is an insulator or dielectric. The EL can be thought of as a capacitor in parallel with a resistor with the two conductive sheets of foil of a conventional capacitor replaced by the conductive materials on either side of the dielectric. EL's are commonly used as illuminated back plates for watches and illuminated displays for automobile dashboards.

Each time the voltage changes polarity in the EL, a small amount of current flows in the phosphor. This current acts in a similar manner to the electrons striking the phosphor in a cathode ray tube. With each reversal of polarity, some light is created at the EL. Instead of aluminum foil such as used in many capacitors, applicant uses a transparent conductor on one side, The light created is thus visible to the user.

Different colors are created with different phosphors. The brightness is determined by the amount of current flowing in the EL. The current and the brightness increase with an increase in voltage and frequency.

Figure 6:
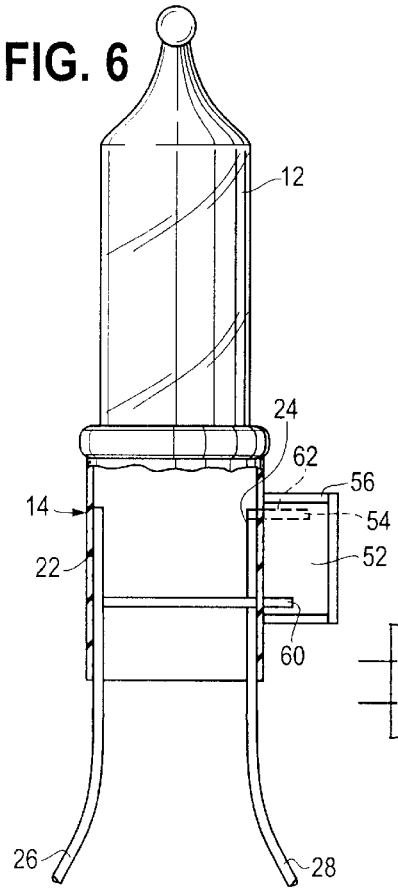
FIG. 6 is a side elevation view of a miniature lamp and socket in which an electroluminescent lamp is mounted on the side of the socket.

One of the main problems with using an EL is the difficulty in connecting power leads to the conductive materials on both sides of the EL. The conductive materials are generally thin and flimsy. In order to overcome this problem, applicant proposes to have an EL 58 mounted on or integrally formed with the 16 of the socket 14. (FIG. 6.) The terminal wires 22 and 24 have EL wires 60 and 62 connected in parallel with the lamp wires 18, 20. One wire 60 is connected to one side 52 of the EL and the other wire 62 is connected to the other side 54 of the EL. The EL may be protected with a clear plastic cover 56. The lamp 12 is mounted into the socket 14 as in a conventional socket.

A seen in FIG. 7 a pad of conductive material such as aluminum paint 64 is placed on a comer of the side 52 of the EL. A second pad of conductive material or aluminum paint 66 is placed on the other side 54. Another method is to affix terminals that are eyeletted to each side of the EL. Other methods can also be used such as would be apparent to those skilled in the art. Care must be exercised to keep from shorting one side of the EL, to its opposite side.

FIG. 5 shows a series of EL's 58 connected in parallel with each lamp 12. When a lamp such as lamp 12 bums out or fails to make contact with its socket, the voltage across the El 58 connected in parallel with it sees a sudden increase in voltage to the line voltage as previously described. The EL 58 glows as a result. This indicates that the lamp 12 is "off". The user is easily directed to the defective socket or burned out lamp. In practice, up to three lamps may be "off" or burned out and the line voltage of 120 volts is sufficient to illuminate three EL's as each EL has 40 volts applied to it. This is sufficient to cause it to glow. The EL works well in a dimly lit or darkened room as the EL's brightness makes it stand out compared to its darkened surroundings. This is especially true if more than one lamp is not functioning.

Figure 8:
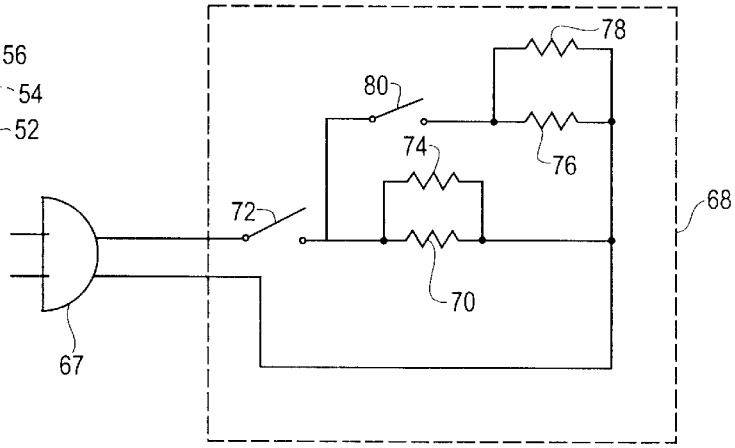
FIG. 8 is an electrical schematic diagram of a home appliance device using applicant's resistance indicator to detect the status of the circuit.

FIG. 8 illustrates using applicant's invention as a voltage detector to indicate the status of an electrical circuit. For example, in an appliance such as a coffee maker 68, there is a plug 67 adapted for plugging into a power source. This is connected to a coffee pot warming element 70 which is essentially a resistance heater. The warming element 70 is turned on and off by a switch 72. In conventional coffee makers, there is an LED or similar electrical light that is energized when the switch 72 is closed indicating that the warming element is on.

There is also a resistor 74 connected in parallel with the warming element 70. The resistor 74 has the same voltage applied to it as across the warming element 70. The resistor 74 is coated with thermochromic paint as previously described. Alternatively the resistor 74 is mounted adjacent to a substrate coated with thermochromic paint. In either case, when the switch 72 is closed, the resistor 74 will have the line voltage applied across it causing it to warm up. The resistor 74 is sized so that it warms quickly to a high enough temperature to cause the thermochromic paint to change states. This gives a visual indication that the circuit controlled by the switch 72 is closed. The result is the same as using an LED except the cost of the resistor is less than one cent.

FIG. 8 illustrates another circuit for a coffee maker in which there is a water heater resistance heater 76 controlled by a thermostat switch 80. Another resistor 78 is connected in parallel with the heater 76. The switch 80 turns on when the water is to be heated and shuts off when the brewing is finished and there is not any more water to be boiled and dripped through the coffee. Thus the resistor 78 has the full line voltage passing through it when the switch is closed and no voltage passing through it when the thermostat switch 80 is opened. The resistor 78 also has thermochromic paint applied to it or to a substrate that it is associated to indicate when the thermostat switch 80 is closed, energizing the water heating circuit. The resistor 74 and warming element 70 remain energized so that the coffee remains warm, and the user knows that power is still applied to the coffee maker. Of course the resistors 74 and 78 can only be used in an environment where there is sufficient ambient light to see the change in state of the thermochromic paint. Also there is a small time delay before the resistor heats up enough to change the condition of the thermochromic paint.

This application of a voltage indicating device can be used in numerous applications where LED's have previously been used. The cost is substantially less than LED's. The disadvantages are the requirement that there be sufficient ambient light to see the change of the paint and there is a time delay before the thermochromic paint changes its condition.

While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A method for indicating a non functioning lamp or socket in a string of miniature electrical lights comprising the steps of:

(a) providing a plurality of miniature sockets, each socket having disposed therein a miniature lamp, the socket and its respective lamp connected in a series circuit;

(b) providing a plurality of resistors with thermochromic paint applied over the resistor, one resistor for each of the miniature lamps;

(c) electrically connecting one of the resistors in parallel with each one of the miniature lamps in the series circuit;

(d) automatically providing an electrical signal to the resistor connected in parallel with its respective miniature lamp when the lamp malfunctions; and (e) energizing the resistor responsive to the electrical signal thereby increasing the temperature of the resistor, and the thermochromic paint changing its physical appearance when the thermochromic paint reaches a threshold temperature responsive to its energization thereby indicating which lamp is not functioning.

2. The method of claim 1 wherein the electrical signal is an increase in voltage.

3. The method of claim 1 wherein the thermochromic paint loses its color to expose the resistor when the thermochromic paint reaches the threshold temperature.

4. The method of claim 1 wherein the thermochromic paint changes its color responsive to the increase in resistor temperature above the threshold temperature.

5. A light string having a plurality of lights connected in a series circuit comprising:

a plurality of lamp sockets, each socket having a first electrical wire and a second electrical wire, first and second electrical contacts within each socket, the first and second electrical wires electrically connected to the first and second electrical contacts respectively, a miniature lamp mounted in each of the lamp sockets, each lamp electrically connected to the first and second electrical contacts when the lamp is mounted in the socket, a power line for electrically connecting the first and second electrical wires to a power source having a line voltage, and a resistor connected in parallel with each of the miniature lamps, the resistor associated with a thermochromic material that assumes a first condition when the lamp that the resistor is connected in parallel with is energized in an "on" condition, and the thermochromic paint assumes a second condition when the lamp that the resistor is connected in parallel with is burned out or non functioning when the string of lights is energized with the power from the power source.

6. The light string of claim 5 wherein when the lamp is in the "on" condition, the voltage across the resistor is equal to the line voltage divided by the number of lamps in the series circuit, and in the burned out or non functioning condition, the voltage across the resistor is substantially the line voltage.

7. The light string of claim 6 wherein the resistor has a base first color and is coated with the thermochromic material, the first condition being opaque and the second condition being translucent to expose the base first color when the lamp that the resistor is connected in parallel with is burned out or non-functioning.

8. The light string of claim 6 wherein the thermochromic material is a thermochromic paint having color pigment in it and the resistor is coated with the thermochromic paint, the first condition being opaque and the second condition being translucent to expose the color pigment in the paint when the lamp that the resistor is connected in parallel with is burned out or non-functioning.

9. The light string of claim 6 and further comprising a base plate coated with the thermochromic material and the base plate mounted adjacent to the resistor.

10. The light string of claim 6 wherein the resistor is mounted on the socket.

11. The light string of claim 6 wherein the resistor is mounted adjacent to the socket and electrically connected to the first and second electrical wires.

12. A light string having a plurality of lights connected in a series circuit comprising:

a plurality of sockets, each socket connected in a series circuit, and having a first electrical wire and a second electrical wire, a miniature lamp mounted in each of the lamp sockets, each lamp electrically connected to the first and second electrical wires when the lamp is mounted in the socket, means for electrically connecting the first and second electrical wires to a power source for providing a line voltage to the series circuit, and signaling means connected in parallel with each of the miniature lamps, the signaling means comprising an audible alarm that is in an "off" condition when the lamp that the audible alarm is connected in parallel with is energized in an "on" condition, and the audible alarm providing an audible indication representing an "on" condition when the lamp that the audible alarm is connected in parallel with is burned out or non functioning when the string of lights is energized from the power source.

13. A method for indicating that an electric circuit having a resistive load connected in the circuit is energized comprising the steps of:

(a) providing a signaling device electrically connected in parallel with the resistive load;

(b) energizing the electric circuit; [and]

(c) energizing the signaling device simultaneously with energizing the electric circuit with sufficient power to activate the signaling device when the resistive load is energized; and (d) providing an output from the signaling device responsive to its activation thereby indicating that the resistive load has a voltage applied across it.

14. The method of claim 13 wherein the signaling device comprises a resistor connected in parallel with each lamp, the resistor increasing its temperature responsive to its energization.

15. The method of claim 14 wherein the signaling device further comprises thermochromic paint applied over the resistor, the thermochromic paint losing its color to expose the resistor when the thermochromic paint reaches a threshold temperature.

16. The method of claim 14 wherein the signaling device further comprises a thermochromic paint applied over the resistor, the thermochromic paint changing its color responsive to the increase in resistor temperature above a threshold temperature.

17. A device for indicating the presence of voltage in an electric circuit having a resistive load comprising:

a resistor electrically connected in parallel with the resistive load, the resistor having thermochromic paint applied over the resistor and connected in parallel with the resistive load, the resistor increasing its temperature responsive to a voltage applied to the resistive load, the thermochromic paint changing its physical color characteristics when the thermochromic paint reaches a threshold temperature thereby indicating that the resistive load has a voltage applied across.

18. The device of claim 17 wherein the signaling device comprises an electroluminescent light connected in parallel with the resistive load, the electroluminescent light illuminating responsive to it's the threshold voltage applied to the resistive load.

19. A method for indicating that an electric circuit having a resistive load connected in the circuit is energized comprising the steps of:

(a) providing an electroluminescent device electrically connected in parallel with the resistive load, the electroluminescent device illuminating responsive to its energization;

(b) energizing the electric circuit; and (c) energizing the electroluminescent device simultaneously with energizing the electric circuit thereby indicating that the resistive load has a voltage applied across it.

* * * * *